US009411257B2

(12) United States Patent
Honda et al.

(10) Patent No.: US 9,411,257 B2
(45) Date of Patent: Aug. 9, 2016

(54) APPARATUS FOR INCREASING THE LIFESPAN OF LIGHT EMITTING UNITS AND IMAGE FORMING APPARATUS HAVING THE SAME

(71) Applicants: Yuki Honda, Kanagawa (JP); Takuma Nishio, Kanagawa (JP)

(72) Inventors: Yuki Honda, Kanagawa (JP); Takuma Nishio, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/797,503

(22) Filed: Jul. 13, 2015

(65) Prior Publication Data

US 2016/0077457 A1 Mar. 17, 2016

(30) Foreign Application Priority Data

Sep. 17, 2014 (JP) ..... 2014-189496

(51) Int. Cl.
*G03G 15/043* (2006.01)

(52) U.S. Cl.
CPC ..... *G03G 15/043* (2013.01)

(58) Field of Classification Search
CPC ..... G06K 15/1247; B41J 2/45; H04N 1/502; G03G 15/01; G03G 15/0126; G03G 15/04045; G03G 15/0849; G03G 18/0853; G03G 15/32; G03G 15/326; G03G 15/36; G03G 15/50; G03G 15/502; G03G 15/5041; G03G 17/00; G03G 5/02

See application file for complete search history.

(56) References Cited

U.S. PATENT DOCUMENTS

| | | | | | |
|---|---|---|---|---|---|
| 4,780,731 | A * | 10/1988 | Creutzmann | ..... | G06K 15/1247 347/237 |
| 5,488,404 | A * | 1/1996 | Fleck | ..... | G06K 15/1247 347/130 |
| 8,988,005 | B2 * | 3/2015 | Jungwirth | ..... | H05B 33/0824 315/122 |
| 2010/0238261 | A1 * | 9/2010 | Maeda | ..... | B41J 2/473 347/246 |
| 2011/0058237 | A1 * | 3/2011 | Mikami | ..... | H04N 1/40056 358/509 |
| 2014/0168343 | A1 | 6/2014 | Suzuki et al. | | |

FOREIGN PATENT DOCUMENTS

| | | | | |
|---|---|---|---|---|
| JP | 2010-214612 | | 9/2010 | |
| JP | 5629975 | B2 * | 11/2014 | ..... B41J 2/473 |

* cited by examiner

*Primary Examiner* — Francis Gray
(74) *Attorney, Agent, or Firm* — Harness, Dickey & Pierce, P.L.C.

(57) ABSTRACT

An image forming apparatus is provided. The image forming apparatus includes a light source including a plurality of light emitting units to emit light corresponding to image data, and a light source controller to independently control lighting of each one of the light emitting units. The light source controller switches activation and deactivation of one or more of the light emitting units when the number of to-be-used light emitting units is smaller than the total number of the light emitting units included in the light source.

18 Claims, 6 Drawing Sheets

APPARATUS FOR INCREASING THE LIFESPAN OF LIGHT EMITTING UNITS AND IMAGE FORMING APPARATUS HAVING THE SAME

CROSS-REFERENCE TO RELATED APPLICATIONS

This patent application is based on and claims priority pursuant to 35 U.S.C. §119(a) to Japanese Patent Application No. 2014-189496, filed on Sep. 17, 2014, in the Japan Patent Office, the entire disclosure of which is hereby incorporated by reference herein.

BACKGROUND

1. Technical Field

The present disclosure relates to an image forming apparatus and an image forming method.

2. Description of the Related Art

In some electrophotographic image forming apparatuses, scanning exposure is performed using a light source having a plurality of light emitting units whose lighting is independently controllable.

Such an image forming apparatus in which scanning exposure is performed using a light source having a plurality of light emitting units is able to write the same number of line images as the light emitting units on a photoconductor at once. This makes it possible to shorten page printing time and increase printing speed.

As the light source, laser diode array (LDA), vertical cavity surface emitting laser (VCSEL), or the like, has been used.

Laser diode (LD) gradually deteriorates with use and reaches the end of its life when exceeding the allowable limit.

Usually, we replace parts in good time before they deteriorate. Parts are replaced at an appropriate time before they reach the predicted ends of their life.

With respect to LD, it is already known that the length of lighting time gives an indication of its lifespan.

SUMMARY

In accordance with some embodiments of the present invention, an image forming apparatus is provided. The image forming apparatus includes a light source including a plurality of light emitting units to emit light corresponding to image data, and a light source controller to independently control lighting of each one of the light emitting units. The light source controller switches activation and deactivation of one or more of the light emitting units when the number of to-be-used light emitting units is smaller than the total number of the light emitting units included in the light source.

In accordance with some embodiments of the present invention, an image forming method is provided. The image forming method includes the steps of emitting light corresponding to image data from a light source including a plurality of light emitting units; and switching activation and deactivation of one or more of the light emitting units when the number of to-be-used light emitting units is smaller than the total number of the light emitting units included in the light source.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
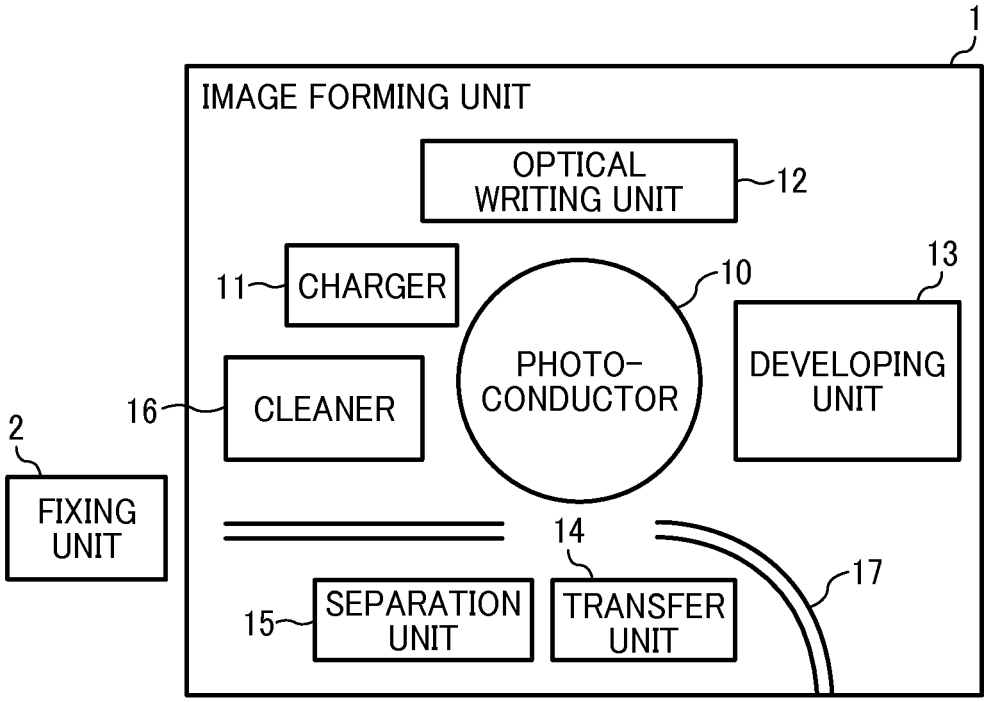
FIG. 1 is a schematic view of an image forming apparatus according to an embodiment of the present invention which is a laser printer.

The accompanying drawings are intended to depict example embodiments of the present invention and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments shown in the drawings, specific terminology is employed for the sake of clarity. However, the present disclosure is not intended to be limited to the specific terminology so selected and it is to be understood that each specific element includes all technical equivalents that operate in a similar manner.

In the following description, illustrative embodiments will be described with reference to acts and symbolic representations of operations (e.g., in the form of flowcharts) that may be implemented as program modules or functional processes including routines, programs, objects, components, data structures, etc., that perform particular tasks or implement particular abstract data types and may be implemented using existing hardware at existing network elements or control nodes. Such existing hardware may include one or more Central Processing Units (CPUs), digital signal processors (DSPs), application-specific-integrated-circuits, field programmable gate arrays (FPGAs) computers or the like. These terms in general may be referred to as processors.

Unless specifically stated otherwise, or as is apparent from the discussion, terms such as "processing" or "computing" or "calculating" or "determining" or "displaying" or the like, refer to the action and processes of a computer system, or similar electronic computing device, that manipulates and transforms data represented as physical, electronic quantities within the computer system's registers and memories into other data similarly represented as physical quantities within the computer system memories or registers or other such information storage, transmission or display devices.

A conventional image forming apparatus using a light source having a plurality of light emitting units, such as laser diode array, sometimes performs scanning exposure without using all the light emitting units depending on printing mode. For example, in the case of 2ch LDA, scanning exposure may be performed using only one light emitting unit. This causes variation in lifespan among the plurality of light emitting units.

In view of this situation, one object of the present invention is to suppress variation in lifespan among a plurality of light emitting units in a light source and extend the lifespan of the light source.

In accordance with some embodiments of the present invention, an image forming apparatus which can suppress variation in lifespan among multiple light emitting units in a light source and extend the lifespan of the light source is provided.

FIG. 1 is a schematic view of an image forming apparatus according to an embodiment of the present invention that is a laser printer.

The laser printer includes an image forming unit 1 and a fixing unit 2. The laser printer further includes an image processor that performs necessary image processing for print data, a paper feeder that feeds printing paper to the image forming unit 1, and a paper ejection unit that ejects the printing paper having an image having been formed in the image forming unit 1 and fixed thereon in the fixing unit 2. The laser printer further includes a data receiver that receives print data from an external device such as a personal computer or scanner, and an operation display that displays operation keys to set operation mode of the laser printer and other various information.

The image forming unit 1 includes a photoconductor 10 in a drum-like shape rotary drivable. Around the photoconductor 1, a charger 11, an optical writing unit 12, a developing unit 13, a transfer unit 14, a separation unit 15, and a cleaner 16 are provided.

In the image forming unit 1, an outer peripheral surface of the photoconductor 10 is uniformly charged by the charger 11 while the photoconductor 10 is rotating, and the charged surface is irradiated with a laser beam modulated based on image data emitted from the optical writing unit 12, thereby forming an electrostatic latent image on the outer peripheral surface of the photoconductor 10.

The developing unit 13 then supplies toner serving as a developer to the photoconductor 10, thereby forming a toner image serving as a developer image.

The transfer unit 14 then transfers the toner image from the photoconductor 10 onto a printing paper sheet serving as a recording medium having been fed to between the photoconductor 10 and the transfer unit 14 through a paper feeding path 17 from the paper feeder.

The separation unit 15 then separates the printing paper sheet having the transferred toner image thereon from the photoconductor 10 and feeds it to the fixing unit 2.

The fixing unit 2 includes a heat roller rotary drivable and heatable to a predetermined fixing temperature, a pressure roller in contact with the heat roller and rotatable along with the heat roller, and a heater to heat the heat roller to a predetermined fixing temperature. The fixing unit 2 feeds the printing paper sheet having the transferred toner image thereon while the heat roller and the pressure roller are applying heat and pressure to it, thereby fixing the toner image on the printing paper sheet.

After completion of the transfer of the toner image, the cleaner 16 neutralizes the photoconductor 10 and removes residual toner particles therefrom. The charger 11 then uniformly charges the photoconductor 10 to perform image formation again.

Figure 2:
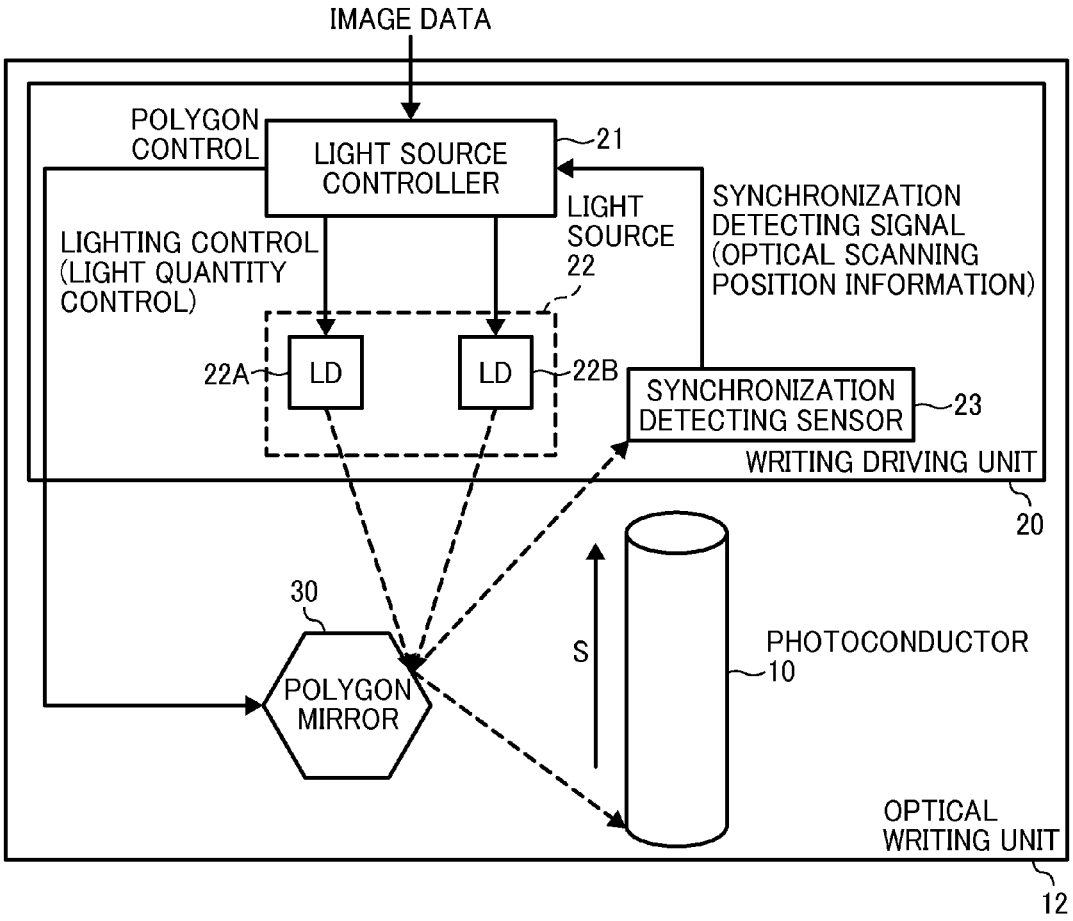
FIG. 2 is a block diagram of a major part of the optical writing unit illustrated in FIG. 1.

FIG. 2 is a block diagram of a major part of the optical writing unit 12. In FIG. 2, each dashed array indicates a laser beam.

Upon receipt of image data from an external device such as personal computer or built-in scanner, a controller (such as CPU (central processing unit)) of the laser printer inputs the received image data to the optical writing unit 12. The optical writing unit 12 generates a laser beam modulated based on the image data.

The optical writing unit 12 includes a writing driving unit 20 and a polygon mirror 30.

The writing driving unit 20 includes a light source controller 21, a light source 22, and a synchronization detecting sensor 23 having a photodiode. The light source 22 is a laser diode array (hereinafter "LDA") including two laser diodes (hereinafter "LD") 22A and 22B that emit laser light beams. Hereinafter, LD22A and LD22B may be referred to as LD1 and LD2, respectively.

The writing driving unit 20 further includes an fθ lens, a reflection mirror, a synchronous reflection mirror, or the like.

The polygon mirror 30 is a rotary multifaced mirror rotatable by a polygon motor with an angular velocity in accordance with the image density of the laser printer. The polygon mirror 30 illustrated in FIG. 2 has a regular hexagonal planer shape and six reflection surfaces on its outer periphery.

The light source 22, synchronization detecting sensor 23, and polygon mirror 30 are controlled by the light source controller 21. The light source controller 21 independently controls lighting of a plurality of light emitting units LD22A and LD22B (LD1 and LD2) in the light source 22.

More specifically, upon input of image data, the light source controller 21 controls lightings of the LD22A and LD22B by means of a writing clock or timing control signal based on the image data. The light source controller 21 is implemented by, for example, a control board, memory, LD driver, or the like.

Laser beams emitted from LD22A and/or LD22B in the light source 22 are reflected by the polygon mirror 30 and become a laser beam used for optical scanning. The laser beam then passes through the fθ lens and is reflected by the reflection mirror, thereby forming an image on the photoconductor 10.

As the polygon mirror 30 rotates, the incident position (reflection position) of the laser beam on the reflection mirror moves in the direction of arrow S, and the imaging position on the photoconductor 10 also moves in the direction of arrow S. The direction of arrow S is coincident with the generating line of the cylinder of the photoconductor 10 and the main scanning direction.

A part of the laser beam having passed through the fθ lens enters the synchronous reflection mirror disposed near a position on the scanning line of the laser beam on the photoconductor 10 deviated from the image forming area. The synchronous reflection mirror reflects the entered laser beam toward the synchronization detecting sensor 23.

As the reflected laser beam enters, the synchronization detecting sensor 23 generates a synchronization detecting signal that is a pulse output. The light source controller 21 sets an effective scanning period during which an image is written on the photoconductor 10 based on the synchronization detecting signal.

FIGS. 3 to 6 are timing diagrams for explaining switching of activation and deactivation of light emitting units in the light source 22. In FIGS. 3 to 6, image area signal represents a signal showing a writing area in a sub-scanning direction. One assertion period of the image area signal coincides with a period of printing on one sheet of paper.

LD1 lighting signal and LD2 lighting signal represent signals for controlling lighting of LD22A (LD1) and LD22B (LD2), respectively, in the light source 22. Both of them are output from the light source controller 21.

During each assertion period of the image area signal, each LD lighting signal includes multiple main scanning lines. Each main scanning line includes synchronization lighting, APC (Auto Power Control) lighting, and main scanning image area lighting. Here, these lightings are omitted from the figures for the sake of simplicity. During a negation period between successive assertion periods of the image area signal, each LD lighting signal performs synchronization lighting and APC lighting. These lightings are also omitted from the figures for the sake of simplicity.

Figure 3:
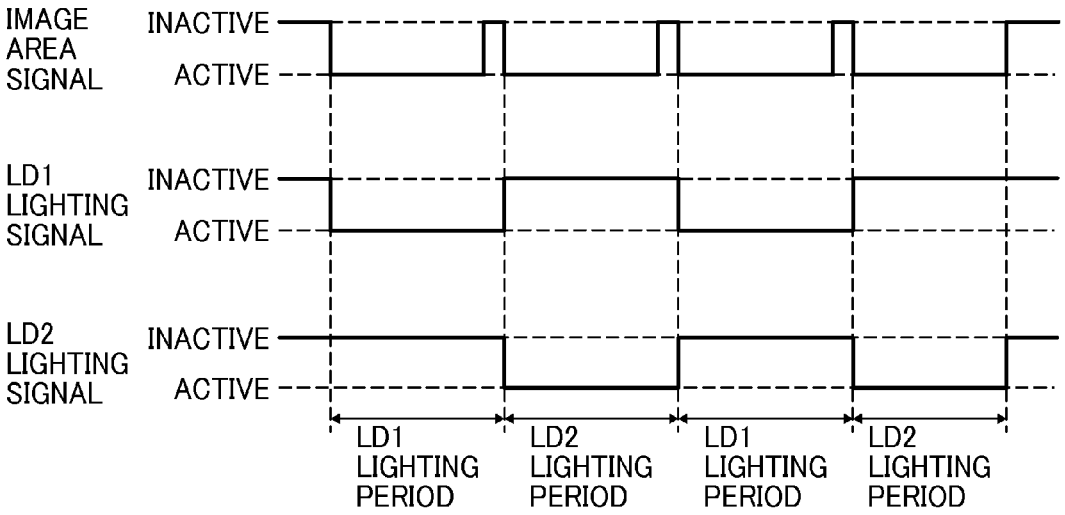
FIG. 3 is a timing diagram for explaining switching of light emitting units with respect to 2ch LDA.

FIG. 3 shows a case in which 2ch LDA is used as the light source 22 in the optical writing unit 12 and 4-sheet continuous printing is performed in 1-beam mode. The 2ch LDA represents a 2-channel laser diode array having 2 laser diodes serving as light emitting units.

The image area signal is asserted (put into an active state) for every one sheet of paper. Once printing is started, an assertion of the image area signal corresponding to the first sheet of paper triggers an assertion of the LD1 lighting signal.

An assertion of the image area signal corresponding to the second sheet of paper triggers a negation (an inactive state) of the LD1 lighting signal and an assertion of the LD2 lighting signal. Namely, the LD1 lighting signal is asserted when printing an odd-numbered sheet of paper, and the LD2 lighting signal is asserted when printing an even-numbered sheet of paper. Lighting is alternately switched between LD1 and LD2 every time the sheet of paper for printing is changed.

This operation makes it possible to eliminate deviation in the operating time between LD1 and LD2, i.e., two light emitting units in the light source 22, and to extend the lifespan of the light source 22.

Figure 4:
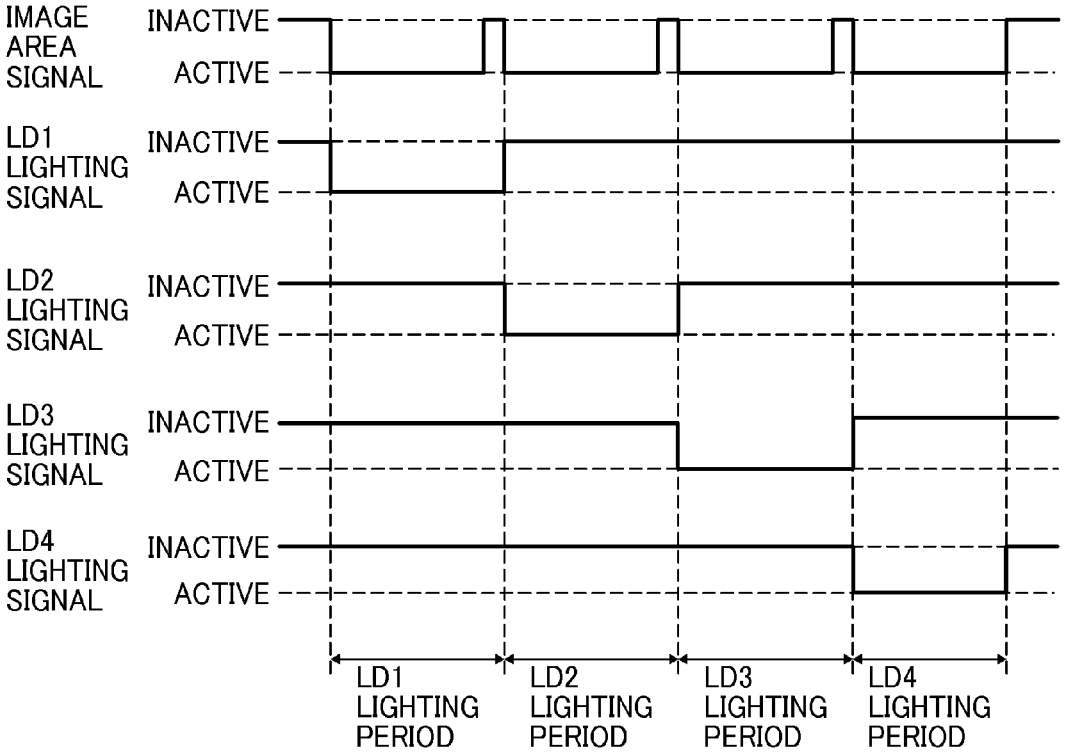
FIG. 4 is a timing diagram for explaining switching of light emitting units in 1-beam mode with respect to 4ch LDA.

FIG. 4 shows a case in which 4ch LDA is used as a light source in an optical writing unit and 4-sheet continuous printing is performed in 1-beam mode.

The optical writing unit in this case has the same configuration as the optical writing unit 12 illustrated in FIG. 2 except for replacing the light source 22 with a 4-channel laser diode array having 4 laser diodes serving as light emitting units.

LD1 lighting signal, LD2 lighting signal, LD3 lighting signal, and LD4 lighting signal represent signals for controlling lighting of LD1, LD2, LD3, and LD4, respectively.

The image area signal is asserted for every one sheet of paper. Once printing is started, an assertion of the image area signal corresponding to the first sheet of paper triggers an assertion of the LD1 lighting signal. An assertion of the image area signal corresponding to the second sheet of paper triggers a negation of the LD1 lighting signal and an assertion of the LD2 lighting signal. An assertion of the image area signal corresponding to the third sheet of paper triggers a negation of the LD2 lighting signal and an assertion of the LD3 lighting signal. An assertion of the image area signal corresponding to the fourth sheet of paper triggers a negation of the LD3 lighting signal and an assertion of the LD4 lighting signal.

Lighting is successively switched among LD1 to LD4 in the order of LD1, LD2, LD3, and LD4 every time the sheet of paper for printing is changed. After termination of lighting of LD4, LD1 is put into a lighting state. This operation is repeated until the printing operation is completed.

This operation makes it possible to eliminate deviation in the operating time among LD1 to LD4, i.e., four light emitting units in the light source, and to extend the lifespan of the light source.

Figure 5:
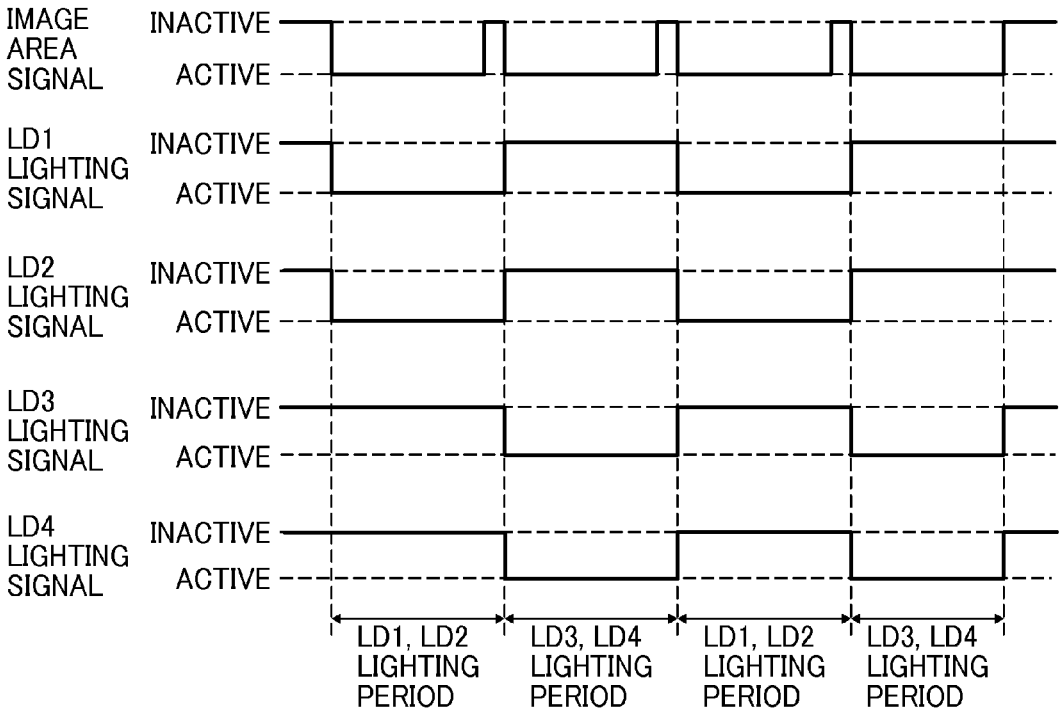
FIG. 5 is a timing diagram for explaining switching of light emitting units in 2-beam mode with respect to 4ch LDA.

FIG. 5 shows a case in which 4ch LDA is used as a light source in an optical writing unit and 4-sheet continuous printing is performed in 2-beam mode.

The optical writing unit in this case has the same configuration as that in the case of FIG. 4. Namely, a 4-channel laser diode array having 4 laser diodes serving as light emitting units is used as the light source.

The image area signal is asserted for every one sheet of paper. Once printing is started, an assertion of the image area signal corresponding to the first sheet of paper triggers assertions of the LD1 lighting signal and LD2 lighting signal. An assertion of the image area signal corresponding to the second sheet of paper triggers negations of the LD1 lighting signal and LD2 lighting signal and assertions of the LD3 lighting signal and LD4 lighting signal. Lighting is alternately switched between a pair of LD1 and LD2 and another pair of LD3 and LD4 every time the sheet of paper for printing is changed.

This operation makes it possible to eliminate deviation in the operating time among LD1 to LD4, i.e., four light emitting units in the light source, and to extend the lifespan of the light source.

A pair of LDs to be simultaneously put into a lighting state is not limited to the above-described combinations. However, it is necessary that any combination of LDs simultaneously put into a lighting state provide lines adjacent to each other in a sub-scanning direction.

Figure 6:
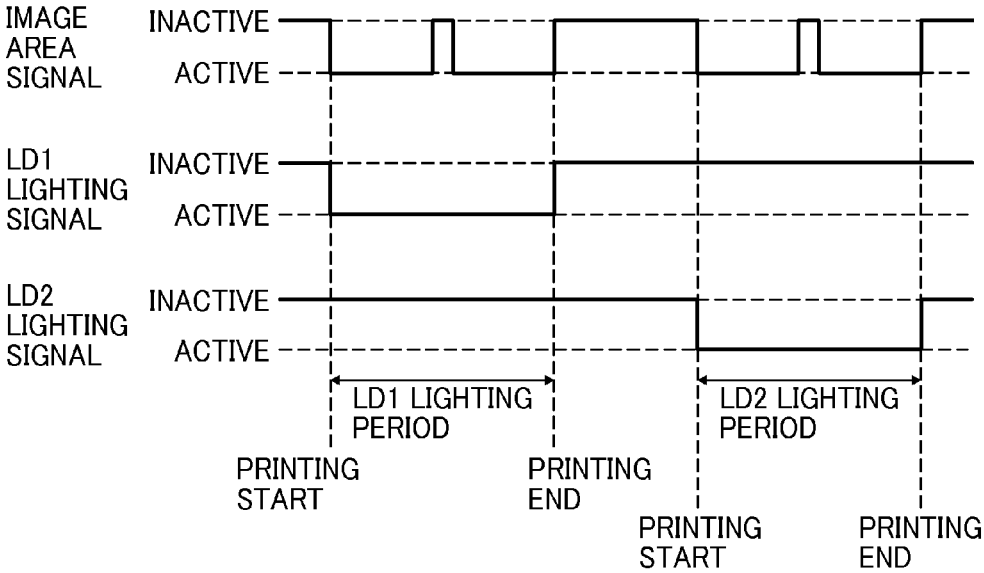
FIG. 6 is a timing diagram for explaining switching of light emitting units per printing job.

FIG. 6 is a timing diagram for explaining switching operation of lighting LDs at every job, while FIGS. 3 to 5 are those for explaining switching operation of lighting LDs at printing every sheet of paper.

FIG. 6 shows a case in which 2ch LDA is used as a light source in an optical writing unit in 1-beam mode, and 2-sheet continuous printing is performed in the first job and the second job.

The image area signal is asserted for every one sheet of paper. Once the first job is started, an assertion of the image area signal corresponding to the first sheet of paper triggers an assertion of the LD1 lighting signal, and the LD1 lighting signal is negated upon completion of the first job.

An assertion of the image area signal corresponding to the sheet of paper in the second job triggers an assertion of the LD2 lighting signal, and the LD2 lighting signal is negated upon completion of the second job. Lighting is switched between LD1 and LD2 at every job.

This operation makes it possible to eliminate deviation in the operating time between LD1 and LD2, i.e., two light emitting units in the light source, through the jobs, and to extend the lifespan of the light source.

The same control can be applied to another case in which 4ch LDA is used as a light source in an optical writing unit in 2-beam mode.

Figure 7:
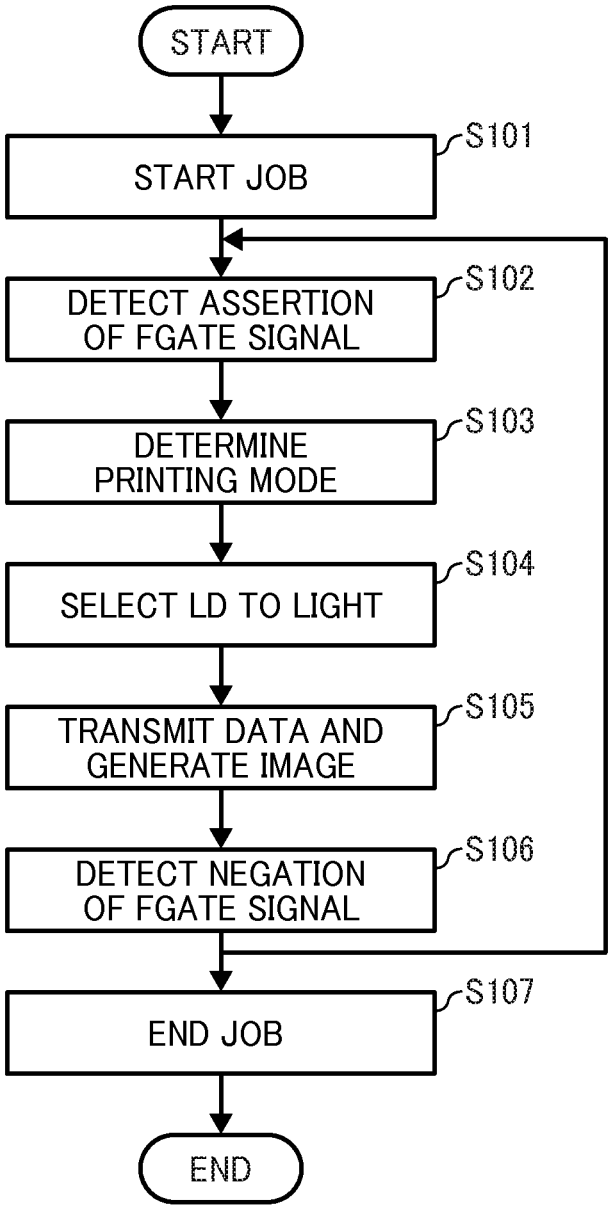
FIG. 7 is a flowchart illustrating a switching operation of lighting LDs at printing every sheet of paper.

FIG. 7 is a flowchart illustrating a switching operation of lighting LDs performed by the light source controller 21 at printing every sheet of paper.

In S101, the light source controller 21 detects an assertion of a job start signal (STTRIG signal) and enters a printing operation state.

In S102, the light source controller 21 detects an assertion of an image area signal (FGATE signal), sets a LD switching flag, and enters an image generation state.

In S103, the light source controller 21 determines printing mode and the number of LDs to light required in the printing operation. For example, in the case where 4ch LDA is used, it is determined that one LD is required to light.

In S104, the light source controller 21 selects LDs to light based on the flag set in S102 and the required number of lighting LDs determined in S103. When the processing has proceeded to S104 through a loop, the light source controller 21 selects LDs to light other than those selected in the previous determination. (For example, in the case where the printing operation uses 4ch LDA and one LD, LD to light is selected in the following manner: LD1→LD2→LD3→LD4→LD1→ . . . )

In S105, the light source controller 21 transmits data to drivers of the selected LDs.

In S106, the light source controller 21 detects a negation of the FGATE signal, removes the LD switching flag, and enters an image generation waiting state. In the case where the FGATE signal is input again, the processing goes back to S102.

In S107, the light source controller 21 detects a negation of the STTRIG signal and enters a printing operation waiting state.

Figure 8:
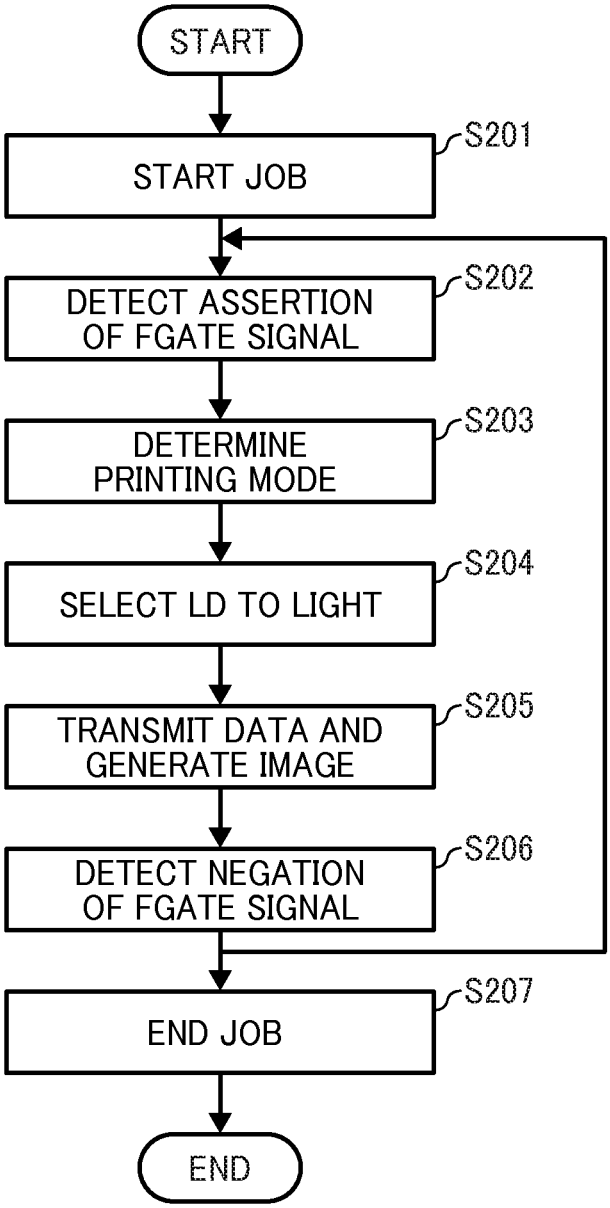
FIG. 8 is a flowchart illustrating a switching operation of lighting LDs at every job.

FIG. 8 is a flowchart illustrating a switching operation of lighting LDs performed by the light source controller 21 at every job.

In S201, the light source controller 21 detects an assertion of a job start signal (STTRIG signal), sets a LD switching flag, and enters a printing operation state.

In S202, the light source controller 21 detects an assertion of an image area signal (FGATE signal) and enters an image generation state.

In S203, the light source controller 21 determines printing mode and the number of LDs to light required in the printing operation. For example, in the case where 4ch LDA is used, it is determined that one LD is required to light.

In S204, the light source controller 21 selects LDs to light based on the flag set in S201 and the required number of lighting LDs determined in S203. When the processing has proceeded to S204 through a loop, the light source controller 21 selects LDs to light other than those selected in the previous determination. (For example, in the case where the printing operation uses 4ch LDA and one LD, LD to light is selected in the following manner: LD1→LD2→LD3→LD4→LD1→ . . . )

In S205, the light source controller 21 transmits data to drivers of the selected LDs.

In S206, the light source controller 21 detects a negation of the FGATE signal and enters an image generation waiting state.

In S107, the light source controller 21 detects a negation of the STTRIG signal, removes the LD switching flag, and enters a printing operation waiting state. In the case where the STTRIG signal is input again, the processing goes back to S202.

Numerous additional modifications and variations are possible in light of the above teachings. It is therefore to be understood that within the scope of the appended claims, the disclosure of the present invention may be practiced otherwise than as specifically described herein. For example, elements and/or features of different illustrative embodiments may be combined with each other and/or substituted for each other within the scope of this disclosure and appended claims.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC) and conventional circuit components arranged to perform the recited functions.

The present invention can be implemented in any convenient form, for example using dedicated hardware, or a mixture of dedicated hardware and software. The present invention may be implemented as computer software implemented by one or more networked processing apparatuses. The network can comprise any conventional terrestrial or wireless communications network, such as the Internet. The processing apparatuses can compromise any suitably programmed apparatuses such as a general purpose computer, personal digital assistant, mobile telephone (such as a WAP or 3G-compliant phone) and so on. Since the present invention can be implemented as software, each and every aspect of the present invention thus encompasses computer software implementable on a programmable device. The computer software can be provided to the programmable device using any storage medium for storing processor readable code such as a floppy disk, hard disk, CD ROM, magnetic tape device or solid state memory device.

The hardware platform includes any desired kind of hardware resources including, for example, a central processing unit (CPU), a random access memory (RAM), and a hard disk drive (HDD). The CPU may be implemented by any desired kind of any desired number of processor. The RAM may be implemented by any desired kind of volatile or non-volatile memory. The HDD may be implemented by any desired kind of non-volatile memory capable of storing a large amount of data. The hardware resources may additionally include an input device, an output device, or a network device, depending on the type of the apparatus. Alternatively, the HDD may be provided outside of the apparatus as long as the HDD is accessible. In this example, the CPU, such as a cache memory of the CPU, and the RAM may function as a physical memory or a primary memory of the apparatus, while the HDD may function as a secondary memory of the apparatus.

What is claimed is:

1. An image forming apparatus, comprising:

a light source including a plurality of light emitting units to emit light corresponding to image data; and a light source controller configured to independently control lighting of each one of the light emitting units in response to an assertion signal corresponding to one of a print page or a print job, the light source controller switching activation and deactivation of one or more of the light emitting units when the number of to-be-used light emitting units is smaller than the total number of the light emitting units included in the light source, wherein the light source controller controls activation of a first light emitting unit in response to a first assertion signal corresponding to a first print page or a first print job and controls deactivation of the first light emitting unit and activation of a second light emitting unit in response to a second assertion signal corresponding to a second print page or a second print job.

2. The image forming apparatus according to claim 1, wherein the light source controller switches the activation and the deactivation of one or more of the light emitting units for every one sheet of paper.

3. The image forming apparatus according to claim 1, wherein the light source controller switches the activation and the deactivation of one or more of the light emitting units for every job.

4. The image forming apparatus according to claim 1, wherein the light source including the plurality of light emitting units is a 2-channel laser diode array having two laser diodes, and wherein the light source controller switches the activation and the deactivation of one or more of the light emitting units in 1-beam mode.

5. The image forming apparatus according to claim 1, wherein the light source including the plurality of light emitting units is a 4-channel laser diode array having four laser diodes, and wherein the light source controller switches the activation and the deactivation of one or more of the light emitting units in 1-beam mode.

6. The image forming apparatus according to claim 1, wherein the light source including the plurality of light emitting units is a 4-channel laser diode array having four laser diodes, and wherein the light source controller switches the activation and the deactivation of one or more of the light emitting units in 2-beam mode.

7. An image forming method, comprising:

emitting light corresponding to image data from a light source including a plurality of light emitting units; and switching activation and deactivation of one or more of the light emitting units when the number of to-be-used light emitting units is smaller than the total number of the light emitting units included in the light source, and activating a first light emitting unit in response to a first assertion signal corresponding to a first print page or a first print job and deactivating the first light emitting unit and activating a second light emitting unit in response to a second assertion signal corresponding to a second print page or a second print job.

8. The image forming method according to claim 7, wherein the switching of the activation and the deactivation of one or more of the light emitting units is performed for every one sheet of paper.

9. The image forming method according to claim 7, wherein the switching of the activation and the deactivation of one or more of the light emitting units is performed for every job.

10. The image forming method according to claim 7, wherein the light source including the plurality of light emitting units is a 2-channel laser diode array having two laser diodes, and wherein the switching of the activation and the deactivation of one or more of the light emitting units is performed in 1-beam mode.

11. The image forming method according to claim 7, wherein the light source including the plurality of light emitting units is a 4-channel laser diode array having four laser diodes, and wherein the switching of the activation and the deactivation of one or more of the light emitting units is performed in 1-beam mode.

12. The image forming method according to claim 7, wherein the light source including the plurality of light emitting units is a 4-channel laser diode array having four laser diodes, and wherein the switching of the activation and the deactivation of one or more of the light emitting units is performed in 2-beam mode.

13. An image forming apparatus, comprising:

a light source including a plurality of light emitting units to emit light corresponding to image data; and means for independently controlling lighting of each one of the light emitting units in response to an assertion signal corresponding to one of a print page or a print job, the means switching activation and deactivation of one or more of the light emitting units when the number of to-be-used light emitting units is smaller than the total number of the light emitting units included in the light source, wherein the means controlling activation of a first light emitting unit in response to a first assertion signal corresponding to a first print page or a first print job and controlling deactivation of the first light emitting unit and activation of a second light emitting unit in response to a second assertion signal corresponding to a second print page or a second print job.

14. The image forming apparatus according to claim 13, wherein the means switches the activation and the deactivation of one or more of the light emitting units for every one sheet of paper.

15. The image forming apparatus according to claim 13, wherein the means switches the activation and the deactivation of one or more of the light emitting units for every job.

16. The image forming apparatus according to claim 13, wherein the light source including the plurality of light emitting units is a 2-channel laser diode array having two laser diodes, and wherein the means switches the activation and the deactivation of one or more of the light emitting units in 1-beam mode.

17. The image forming apparatus according to claim 13, wherein the light source including the plurality of light emitting units is a 4-channel laser diode array having four laser diodes, and wherein the means switches the activation and the deactivation of one or more of the light emitting units in 1-beam mode.

18. The image forming apparatus according to claim 13, wherein the light source including the plurality of light emitting units is a 4-channel laser diode array having four laser diodes, and wherein the means switches the activation and the deactivation of one or more of the light emitting units in 2-beam mode.

* * * * *